US012031530B2

(12) United States Patent
Jansen

(10) Patent No.: US 12,031,530 B2
(45) Date of Patent: Jul. 9, 2024

(54) PUMP AND ASSOCIATED SYSTEM AND METHODS

(71) Applicant: MHWIRTH GMBH, Erkelenz (DE)

(72) Inventor: Roman Jansen, Wassenberg (DE)

(73) Assignee: MHWIRTH GMBH, Erkelenz (DE)

( * ) Notice: Subject to any disclaimer, the term of this patent is extended or adjusted under 35 U.S.C. 154(b) by 275 days.

(21) Appl. No.: 17/442,639

(22) PCT Filed: Mar. 12, 2020

(86) PCT No.: PCT/EP2020/056586
§ 371 (c)(1),
(2) Date: Sep. 24, 2021

(87) PCT Pub. No.: WO2020/193151
PCT Pub. Date: Oct. 1, 2020

(65) Prior Publication Data

US 2022/0186717 A1 Jun. 16, 2022

(30) Foreign Application Priority Data

Mar. 25, 2019 (GB) ..... 1904054

(51) Int. Cl.

| | |
|---|---|
| ***F04B 15/02*** | (2006.01) |
| ***F04B 11/00*** | (2006.01) |
| ***F04B 43/00*** | (2006.01) |
| ***F04B 43/02*** | (2006.01) |
| ***F04B 43/06*** | (2006.01) |

(Continued)

(52) U.S. Cl.
CPC ..... *F04B 15/02* (2013.01); *F04B 11/00* (2013.01); *F04B 11/0008* (2013.01); *F04B 11/0016* (2013.01); *F04B 11/0091* (2013.01); *F04B 43/009* (2013.01); *F04B 43/02* (2013.01); *F04B 43/06* (2013.01); *F04B 43/067* (2013.01); *F04B 43/107* (2013.01)

(58) Field of Classification Search
CPC ..... F04B 43/067; F04B 15/02; F04B 43/009; F04B 43/107; F04B 11/00; F04B 11/0008; F04B 43/02; F04B 43/06; F04B 11/0016; F04B 11/0091
See application file for complete search history.

(56) References Cited

U.S. PATENT DOCUMENTS 2,474,512 A 6/1949 Bechtold et al.
2,773,455 A * 12/1956 Mercier ..... F04B 11/0016 138/30

(Continued)

FOREIGN PATENT DOCUMENTS

CN 101365877 A 2/2009
CN 104813091 A 7/2015

(Continued)

*Primary Examiner* — Peter J Bertheaud
(74) *Attorney, Agent, or Firm* — Norman B. Thot

(57) ABSTRACT

A pump for pumping a pumping mud or a slurry. The pump includes a housing having a pump chamber and an intermediate fluid chamber, a membrane arranged within the housing, a reciprocal pumping member operatively arranged in the intermediate fluid chamber, and an accumulator fluidly connected to the intermediate fluid chamber via a throttle. The pump chamber has a fluid inlet and a fluid outlet. The membrane delimits the pump chamber from the intermediate fluid chamber.

8 Claims, 2 Drawing Sheets

(51) Int. Cl.
*F04B 43/067* (2006.01)
*F04B 43/107* (2006.01)

(56) References Cited

U.S. PATENT DOCUMENTS

| | | | | | |
|---|---|---|---|---|---|
| 3,151,562 | A * | 10/1964 | Swartz | F04B 43/107 92/144 |
| 5,165,869 | A * | 11/1992 | Reynolds | F04B 43/009 417/388 |
| 6,032,929 | A | 3/2000 | Vatne | |
| 6,116,871 | A | 9/2000 | Backéet al. | |
| 8,388,321 | B2 * | 3/2013 | Wilmsen | F04B 17/03 92/96 |
| 8,920,146 | B2 | 12/2014 | Heinrichs | |
| 9,695,808 | B2 | 7/2017 | Giessbach et al. | |
| 2003/0194328 | A1 | 10/2003 | Bryant et al. | |
| 2004/0031529 | A1 | 2/2004 | Kach | |
| 2008/0292483 | A1 | 11/2008 | De Koning | |
| 2010/0014996 | A1 | 1/2010 | Wilmsen | |
| 2010/0278669 | A1 | 11/2010 | West et al. | |
| 2011/0236236 | A1 | 9/2011 | Larsen et al. | |
| 2015/0260178 | A1 | 9/2015 | Giessbach | |
| 2015/0267854 | A1 | 9/2015 | Selwyn | |
| 2018/0258924 | A1 | 9/2018 | Palladini | |

FOREIGN PATENT DOCUMENTS

| | | | |
|---|---|---|---|
| CN | 105971859 | A | 9/2016 |
| CN | 106460875 | A | 2/2017 |
| CN | 108026907 | A | 5/2018 |
| DE | 197 06 116 | A1 | 8/1998 |
| DE | 10 2018 110 847 | A1 | 11/2019 |
| DE | 10 2018 110 848 | A1 | 11/2019 |
| FR | 2.203.485 | A5 | 5/1974 |
| JP | H07-119628 | A | 5/1995 |
| JP | 4768244 | B2 | 9/2011 |
| SE | 1651226 | A1 | 3/2018 |
| WO | WO 94/19564 | A1 | 9/1994 |
| WO | WO 97/23705 | A1 | 7/1997 |
| WO | WO 2004/071929 | A1 | 8/2004 |
| WO | WO 2008/085031 | A1 | 7/2008 |
| WO | WO 2009/051474 | A1 | 4/2009 |
| WO | WO 2010/066754 | A1 | 6/2010 |
| WO | WO 2018/091306 | A1 | 5/2018 |
| WO | WO 2019/072542 | A1 | 4/2019 |

* cited by examiner

PUMP AND ASSOCIATED SYSTEM AND METHODS

CROSS REFERENCE TO PRIOR APPLICATIONS

This application is a U.S. National Phase application under 35 U.S.C. § 371 of International Application No. PCT/EP2020/056586, filed on Mar. 12, 2020 and which claims benefit to Great Britain Patent Application No. 1904054.2, filed on Mar. 25, 2019. The International Application was published in English on Oct. 1, 2020 as WO 2020/193151 A1 under PCT Article 21(2).

FIELD

The present invention relates to pumps, and in particular to heavy duty fluid pumps for large scale applications, as well as to systems and methods for such pumps.

BACKGROUND

Reciprocating pumps are used in a variety of applications and for a wide range of purposes. One such application is the conveyance of fluids in large-scale plants for earth drilling or mining. Examples of such pumps and their applications are described, for example, in U.S. Pat. No. 8,920,146 B2, US 2015/0260178 A1 and U.S. Pat. No. 9,695,808 B2. The type of pumps described in these examples are commonly used to pump mining slurry (which is also known as coal slurry) or drilling mud, i.e., fluid mixtures with demanding properties, for example, having solid particles suspended therein.

Other documents which may be useful to understand the background include WO 2009/051474 A1; WO 2010/066754 A1; JP 4768244 B2; US 2003/0194328 A1; WO 94/019564 A1; WO 97/23705; WO 2018/091306 A1; WO 2019/072542 A1; DE 10 2018 110 847 A1; and DE 10 2018 110 848 A1.

Such pumps for the applications mentioned above or other, similar fields of use, often have demanding operating conditions, which may include requirements for high output pressures or flow rates and the need to handle challenging media, for example, abrasive liquids and/or liquids containing solid particles. Many such pumps are used in mobile or remote installations, for example, on drilling rigs, and have high demands for operational reliability and low maintenance requirements. In most applications, there is furthermore a desire for low weight and high efficiency. As described in some of the abovementioned documents, pressure pulsations from such reciprocating pumps may also be an undesirable issue in certain applications.

SUMMARY

An aspect of the present invention is to provide fluid pumps with improvements in one or more of the abovementioned aspects compared to known solutions.

In an embodiment, the present invention provides a pump for pumping a pumping mud or a slurry. The pump includes a housing comprising a pump chamber and an intermediate fluid chamber, a membrane arranged within the housing, a reciprocal pumping member operatively arranged in the intermediate fluid chamber, and an accumulator fluidly connected to the intermediate fluid chamber via a throttle.

The pump chamber comprises a fluid inlet and a fluid outlet. The membrane delimits the pump chamber from the intermediate fluid chamber

DETAILED DESCRIPTION

Figure 1:
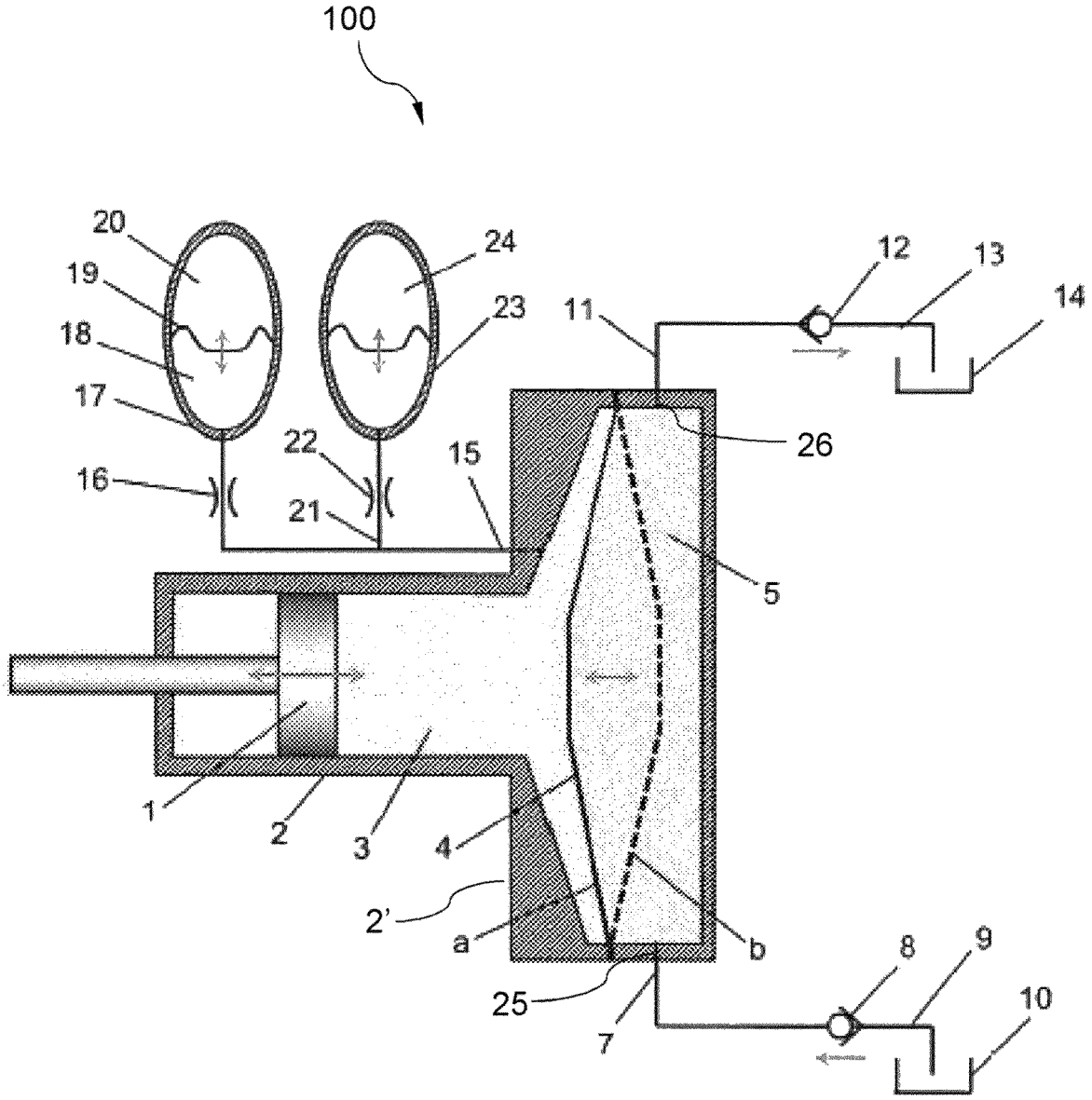
FIG. 1 is a schematic view of a reciprocating pump according to an embodiment of the present invention.

A first aspect of the present invention provides a pump comprising a housing with pump chamber having a fluid inlet and a fluid outlet, a membrane arranged within the housing and delimiting the pump, a chamber from an intermediate fluid chamber, a reciprocal pumping member operatively arranged in the intermediate fluid chamber, and an accumulator fluidly connected to the intermediate chamber via a throttle.

The accumulator may be configured to dampen pressure fluctuations in the intermediate chamber which have a frequency higher than a reciprocating speed of the pump.

The accumulator may be a first accumulator and the throttle a first throttle, wherein the pump comprises a second accumulator fluidly which is connected to the intermediate chamber via a second throttle.

The first accumulator may be configured to dampen pressure fluctuations at a first pressure level (PS) corresponding to a design intake pressure for the pump, and the second accumulator may be configured to dampen pressure fluctuations at a second pressure level (PD) corresponding to a design discharge pressure for the pump.

One or both of the first throttle and the second throttle may be configured to have an adjustable flow resistance.

A second aspect of the present invention provides a method for dampening of pressure fluctuations in a pump. The method comprises providing one or more accumulators fluidly connected to an intermediate chamber of the pump via one or more throttles and dampening, by the one or more accumulators, pressure fluctuations in the intermediate chamber which have a frequency higher than a reciprocating speed of the pump.

The pressure fluctuations may be at a first pressure level corresponding to a design intake pressure for the pump. The pressure fluctuations at the first pressure level may be dampened by a first accumulator.

The pressure fluctuations may be a second pressure level corresponding to a design discharge pressure for the pump. The pressure fluctuations at the second pressure level may be dampened by a second accumulator.

One or more throttles may have an adjustable flow resistance.

In all aspects, the pump may have a design output of more than 1000 kW, more than 1500 kW, or more than 2000 kW pumping power.

In all aspects, the pump may be a pump for pumping slurry or drilling mud.

In all aspects, the maximum design outlet pressure may, for example, be more than 200 bar, more than 250 bar, or more than 300 bar.

These and other characteristics will become clear from the following description of illustrative embodiments, which are provided as non-restrictive examples, with reference to the attached drawings.

The following description may use terms such as "horizontal", "vertical", "lateral", "back and forth", "up and down", "upper", "lower", "inner", "outer", "forward", "rear", etc. These terms generally refer to the views and orientations as shown in the drawings which are associated with a normal use of the present invention. The terms are used for the reader's convenience only and shall not be limiting.

FIG. 1 shows schematic view of a piston diaphragm pump 100 according to an embodiment of the present invention. Certain fundamental working principles of piston pumps and piston membrane pumps are well-known and will therefore not be covered in detail herein. Reference is made, for example, to the abovementioned documents.

The pump 100 has a pump piston 1 (or an equivalent drive element, such as a plunger) which is driven by a drive unit (which is not shown in the drawings) in an oscillating motion and moves within a pump cylinder 2 back and forth. The drive unit may, for example, be a crank system. Via this movement, the pump piston 1 displaces a volume of fluid in an intermediate fluid chamber 3, usually a hydraulic oil. The intermediate fluid chamber 3 is delimited by the pump piston 1, the pump housing 2' (which includes the pump cylinder 2), and a flexible separation membrane 4. Via the flexible separation membrane 4, the intermediate fluid chamber 3 is operatively connected to a pump chamber 5, which contains a medium to be pumped. The medium may, for example, be a mud or a slurry. The movement of the piston 1 thus causes a back-and-forth displacement of the flexible separation membrane 4, and thereby an increase or reduction in the volume of the pump chamber 5, wherein the flexible separation membrane 4 moves between its outer positions a and b. The end stroke position a illustrates the end of a suction stroke/start of a discharge stroke, while the end stroke position b (dashed) illustrates the end of a discharge stroke/start of a suction stroke.

The pump chamber 5 has an inlet 25 and is fluidly connected to a fluid source 10 via a hydraulic line 9, a suction valve 8, and a second hydraulic line 7. The fluid source 10 may, for example, be a pit or a pipe supply of fluid to be pumped by the pump 100. The pump chamber 5 also has an outlet 26 which is fluidly connected to a fluid reservoir 14 (or any other type of fluid receiver, such as piping system, for conveying the pumped fluid for further use) via a hydraulic line 11, a discharge valve 12, and a second hydraulic line 13. The pressure in the fluid reservoir 14 is higher during ordinary operation than at the fluid source 10.

The valves 8,12 are usually provided as passive one-way valves, they may, however, optionally be of a different type, for example, as actively controlled valves. Via the oscillating movement of the pump piston 1 and the resulting volume change of the pump chamber 5, the fluid to be pumped is sucked via the suction valve 8 into the pump chamber 5 and then compressed. When the pressure in the pump chamber 5 and the hydraulic line 11 exceeds that of the second hydraulic line 13 and the fluid reservoir 14, the discharge valve 12 opens and the pumped fluid is conveyed from the pump chamber 5 to the fluid reservoir 14.

When operating a piston diaphragm pump such as pump 100, operational characteristics such as the oscillating movement of the pump piston 1 and the open/close actions of the valves, inherent to the reciprocating pump principle, lead to non-uniform and varying volume flows both in the intake 25 and at the outlet 26 of the pump 100. These characteristics may lead to pressure pulsations in the pumped fluid and/or in the medium in the intermediate fluid chamber 3, which can have a negative effect on the functioning of the pump 100. Such pulsations may, for example, lead to undesirable vibrations in the adjacent piping system or pump components. On the intake side, such pulsations may cause local cavitation, which on the one hand may reduce the efficiency of the pump 100 and on the other hand can cause damage to the pump 100.

Figure 2:
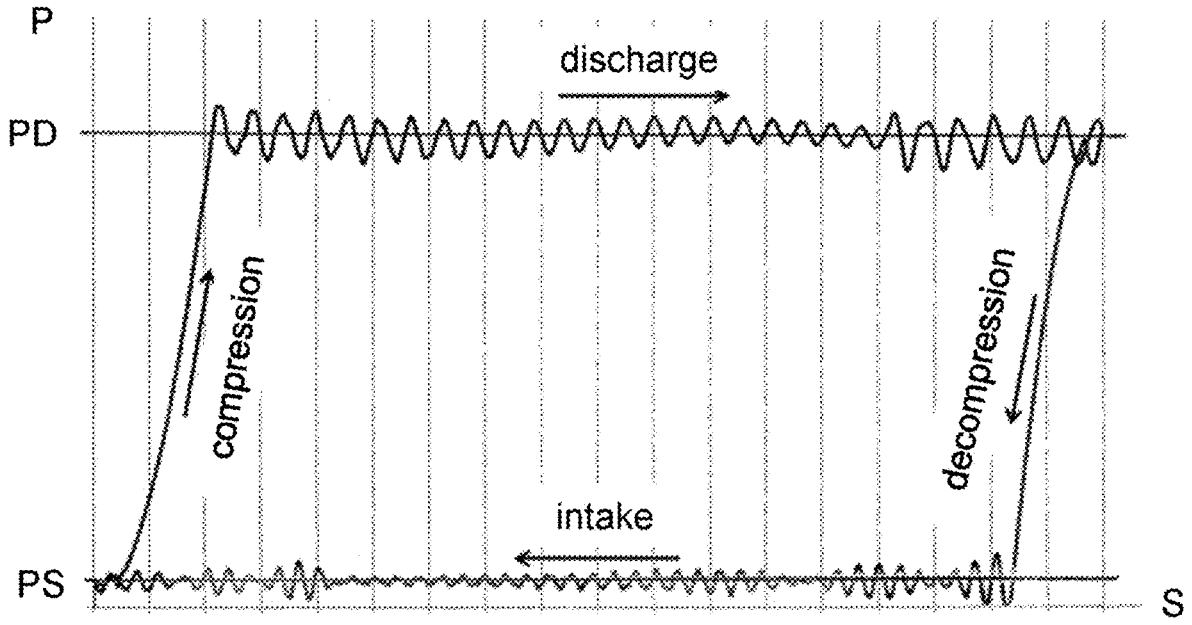
FIG. 2 is an illustrative pressure-stroke plot for one pump cycle.

FIG. 2 illustrates a pressure vs. stroke diagram for the pump over one cycle. P indicates pressure in the pump chamber 5, and S indicates the position of the pump piston 1. Starting at the bottom left (the pump piston 1 being at its leftmost endpoint, the flexible separation membrane 4 being in position 'a' as shown in FIG. 1, and the pump chamber 5 being filled with fluid to be pumped), there is first a compression of the fluid in the pump chamber 5. The fluid may typically have a large liquid fraction, and may therefore only have a limited compressibility, so that a discharge pressure PD, where the discharge valve 12 opens, is reached relatively quickly. As the discharge valve 12 opens, the discharge stroke continues towards the right-hand endpoint of the pump piston 1/flexible separation membrane 4 (position 'b' in FIG. 1). As the pump piston 1 reverses, there is a decompression phase, before the suction valve 8 opens, and an intake (suction) stroke is carried out at a substantially constant suction pressure PS, before the compression phase starts.

During the discharge stroke and/or the intake stroke, pressure pulsations may occur, whereby the pressure in the pumped fluid fluctuates about the discharge pressure PD or the suction pressure PS, as indicated in FIG. 2. These fluctuations may be at frequencies higher than the pump operating frequency, and may cause problems as indicated above. Embodiments described herein may be employed to reduce the risk of such negative effects.

Referring again to FIG. 1, the pump 100 comprises a pressure line 15 connected to the intermediate fluid chamber 3. The pressure line 15 fluidly connects the intermediate fluid chamber 3 with an accumulator 17, via a throttle 16. The accumulator 17 has two chambers, a first chamber 18 which is fluidly connected with the pressure line 15 (via the throttle 16), and a second chamber 20 which comprises a compressible medium such as air or nitrogen. In this embodiment, the compressible medium will be assumed to be a gas, and the fluid in the intermediate fluid chamber 3 will be assumed to be an oil of the same type as in the intermediate fluid chamber 3. The chambers 18 and 20 are usually separated by a flexible membrane 19, however, this is optional and accumulators without such separation membranes may alternatively be used. The accumulator 17 may, for example, be a bladder accumulator. The pressure line 15 and accumulator 17 are independent of the inlet 25 and the hydraulic lines 7,9 associated with the inlet 25, and independent of the outlet 26 and the hydraulic lines 11,13 associated with the outlet 26. The accumulator 17 is only fluidly connected to the intermediate fluid chamber 3.

Pressure fluctuations as illustrated in FIG. 2 may occur during the suction and/or discharge strokes as the pump piston 1 reciprocates during operation of the pump 100. Because the flexible separation membrane 4 is operationally connected to the fluid in the intermediate fluid chamber 3, such pressure fluctuations also lead to pressure fluctuations in the intermediate fluid chamber 3. This causes a flow of oil through the pressure line 15, through the throttle 16, and into the first chamber 18 of the accumulator 17. The gas in second chamber 20 will thereby be compressed and decompressed. As the oil flows through the throttle 16, a part of the pressure/flow energy is converted to heat through throttling resistance. The throttling thus leads to dissipation of energy across the throttle 16. This dissipation of energy thereby converts a part of the pressure or flow energy from such pulsations into heat, thereby reducing such high-frequency pulsations.

The amount of gas in the second chamber 20 may be chosen so that pressure characteristics and dynamic response of the accumulator 17 during the suction and/or discharge stroke of the pump are suitable for efficiently damping out pressure fluctuations. This may in particular include choosing the amount of gas so that the gas pressure relates to the suction pressure PS and/or the discharge pressure PD, as well as to the properties of the throttle 16 and the intermediate fluid, such that the accumulator 17 obtains good pulsation-dampening properties. Selecting the properties of these elements will be a routine design matter when the operating conditions of the pump 100 is known.

Pulsation effects may occur both during the delivery stroke of the pump between the fluid reservoir 14 and the pump chamber 5, and during the suction stroke between the fluid source 10 and the pump chamber 5. As will be appreciated from FIG. 2, the suction stroke and the discharge stroke may be carried out at significantly different pressures. An additional hydraulic accumulator 23 may, for better performance, be connected to the pressure line 15. The additional hydraulic accumulator 23 is fluidly connected to the intermediate chamber via pressure line 15, intermediate pipe 21, and a second throttle 22. The additional hydraulic accumulator 23 has a gas volume 24, similar to accumulator 17.

The gas volume 24 and the gas volume in the second chamber 20 can in this embodiment be chosen so that accumulator 17 provides an efficient dampening of pressure fluctuations during the suction stroke, and the additional hydraulic accumulator 23 provides an efficient dampening of pressure fluctuations during the discharge stroke. The size of the accumulators 17,23, the flow resistance of the throttles 16,22, and other design variables may also naturally be configured according to the expected operating conditions of the pump 100, for example, the expected pressure levels, the type of fluid to be pumped, the fluid used in the intermediate fluid chamber 3, etc. It should be noted that one or both of the throttles 16, 22 may have adjustable flow resistance in order to vary the flow resistance, for example, if the pump 100 is required to operate under varying external operating conditions.

In certain applications, such pressure pulsations may only be prevalent (to a problematic degree) during either the suction stroke or the discharge stroke. A solution with only one accumulator may be sufficient in such a case. It may alternatively be the case that one accumulator can be designed to provide satisfactory dampening of pulsation during both the suction and discharge strokes.

In accordance with embodiments described here, pulsation energy in a pumped fluid is thus converted into heat by throttle effects. As the damper is not arranged in the piping of the pumped medium, but is connected to the intermediate fluid chamber 3 and uses the fluid in this chamber, a reliable dampening effect can be obtained. The characteristics of the fluid in the intermediate fluid chamber 3 is usually well-known, and will not vary with time as may the characteristics of the pumped fluid due to changes in temperature, composition, impurities, etc. The accumulator(s), throttle(s), and other components can therefore be designed using this information to provide good performance. Solutions according to embodiments described herein may, for example, be particularly suitable for pumps which convey fluids with solids content or fluids whose characteristics vary or are challenging to predict. Examples of such fluids may include drilling muds, slurries, or discharge water from mining operations.

The present invention is not limited by the embodiments described above; reference should also be had to the appended claims.

LIST OF REFERENCE NUMERALS

100 Piston diaphragm pump
1 Pump piston
2 Pump cylinder
2' Pump housing
3 Intermediate fluid chamber
4 Flexible separation membrane
5 Pump chamber
7 Hydraulic line
8 Suction valve
9 Hydraulic line
10 Fluid source
11 Hydraulic line
12 Discharge valve
13 Second hydraulic line
14 Fluid reservoir
15 Pressure line
16 Throttle
17 Accumulator
18 First chamber
19 Flexible membrane
20 Second chamber
21 Intermediate pipe
22 Second throttle
23 Additional hydraulic accumulator
24 Gas volume
25 Inlet
26 Outlet
a End of a suction stroke/start of a discharge stroke
b End of a discharge stroke/start of a suction stroke
P Pressure in the pump chamber
PS First pressure level
PD Second pressure level
S Position of pump piston

What is claimed is:

1. A pump for pumping a pumping mud or a slurry, the pump comprising:

a housing comprising a pump chamber and an intermediate fluid chamber, the pump chamber comprising a fluid inlet and a fluid outlet;

a membrane arranged within the housing, the membrane delimiting the pump chamber from the intermediate fluid chamber;

a reciprocal pumping member operatively arranged in the intermediate fluid chamber;

a first accumulator fluidly connected to the intermediate fluid chamber via a first throttle;

a second throttle; and a second accumulator which is fluidly connected to the intermediate fluid chamber via the second throttle, wherein, the pump has a design intake pressure and a design discharge pressure, the first accumulator is configured to dampen pressure fluctuations at a first pressure level which corresponds to the design intake pressure for the pump, and the second accumulator is configured to dampen the pressure fluctuations at a second pressure level which corresponds to the design discharge pressure for the pump.

2. The pump as recited in claim 1, wherein, the pump has a reciprocating speed, and each of the first accumulator and the second accumulator are configured to dampen pressure fluctuations in the intermediate fluid chamber which have a frequency which is higher than the reciprocating speed of the pump.

3. The pump as recited in claim 1, wherein at least one of the first throttle and the second throttle are configured for an adjustable flow resistance.

4. The pump as recited in claim 1, wherein the first throttle provides a two-way fluidic communication between the first accumulator and the intermediate fluid chamber, and the second throttle provides a two-way fluidic communication between the second accumulator and the intermediate fluid chamber.

5. A method for dampening pressure fluctuations in a pump, the method comprising:

operating the pump to pump a pumping mud or a slurry;

providing a first accumulator which is fluidly connected to an intermediate fluid chamber of the pump via at least one throttle;

providing a second accumulator which is fluidly connected to an intermediate fluid chamber of the pump via at least one throttle; and dampening, via the first accumulator and the second accumulator, pressure fluctuations in the intermediate fluid chamber which have a frequency which is higher than a reciprocating speed of the pump, wherein, the pressure fluctuations at a first pressure level which corresponds to a design intake pressure of the pump are dampened by the first accumulator, and the pressure fluctuations at a second pressure level which corresponds to a design discharge pressure of the pump are dampened by the second accumulator.

6. The method as recited in claim 5, wherein each of the at least one throttle has an adjustable flow resistance.

7. The method as recited in claim 5, wherein, the at least one throttle of the first accumulator provides a two-way fluidic communication between the first accumulator and the intermediate fluid chamber, and the at least one throttle of the second accumulator provides a two-way fluidic communication between the second accumulator and the intermediate fluid chamber.

8. A pump for pumping a pumping mud or a slurry, the pump comprising:

a housing comprising a pump chamber and an intermediate fluid chamber, the pump chamber comprising a fluid inlet and a fluid outlet;

a membrane arranged within the housing, the membrane delimiting the pump chamber from the intermediate fluid chamber;

a reciprocal pumping member operatively arranged in the intermediate fluid chamber;

a first accumulator fluidly connected to the intermediate fluid chamber via a first throttle;

a second throttle; and a second accumulator which is fluidly connected to the intermediate fluid chamber via the second throttle, wherein, the first throttle provides a two-way fluidic communication between the first accumulator and the intermediate fluid chamber, and the second throttle provides a two-way fluidic communication between the second accumulator and the intermediate fluid chamber.

* * * * *